US009553394B2

(12) United States Patent
Lee et al.

(10) Patent No.: US 9,553,394 B2
(45) Date of Patent: Jan. 24, 2017

(54) CONNECTOR WITH PLURALITY OF CIRCUIT BOARD CABLE ASSEMBLIES AND OVERMOLD

(71) Applicant: 3M INNOVATIVE PROPERTIES COMPANY, St. Paul, MN (US)

(72) Inventors: Kok Hoe Lee, Singapore (SG); Saujit Bandhu, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/648,482

(22) PCT Filed: Dec. 2, 2013

(86) PCT No.: PCT/US2013/072601

§ 371 (c)(1),
(2) Date: May 29, 2015

(87) PCT Pub. No.: WO2014/099331

PCT Pub. Date: Jun. 26, 2014

(65) Prior Publication Data

US 2015/0318642 A1 Nov. 5, 2015

Related U.S. Application Data

(60) Provisional application No. 61/737,921, filed on Dec. 17, 2012.

(51) Int. Cl.
*H01R 13/648* (2006.01)
*H01R 13/506* (2006.01)
(Continued)

(52) U.S. Cl.
CPC ..... *H01R 13/506* (2013.01); *H01R 13/6592* (2013.01); *H01R 13/665* (2013.01); *H01R 13/719* (2013.01); *H01R 2201/04* (2013.01)

(58) Field of Classification Search
CPC . H01R 13/665; H01R 13/6592; H01R 13/502; H01R 13/516; H01R 23/02; H01R 24/60; H01R 24/62
(Continued)

(56) References Cited

U.S. PATENT DOCUMENTS 7,906,730 B2 * 3/2011 Atkinson ..... H01R 13/6592 174/78
8,770,990 B2 * 7/2014 Sytsma ..... H01R 9/034 439/76.1
(Continued)

FOREIGN PATENT DOCUMENTS

| | | |
|---|---|---|
| CN | 202 373 767 | 8/2012 |
| EP | 2 086 058 | 8/2009 |
| WO | WO 2012/030362 | 3/2012 |

OTHER PUBLICATIONS

PCT International Search Report for PCT/US2013/072601 mailed on Feb. 17, 2014, 3 pages.

*Primary Examiner* — Hae Moon Hyeon
(74) *Attorney, Agent, or Firm* — Robert S. Moshrefzadeh

(57) ABSTRACT

A connector assembly includes a housing, a plurality of circuit board cable assemblies, and an overmold. Each of the circuit board cable assemblies includes a printed circuit board and a pair of shielded cables. The overmold extends and insulate a portion of the shielded cables and a portion of the printed circuit board that includes a plurality of conductive contact pads for electrical connection to the shielded cables.

10 Claims, 7 Drawing Sheets

(51) Int. Cl.
*H01R 13/66* (2006.01)
*H01R 13/6592* (2011.01)
*H01R 13/719* (2011.01)

(58) Field of Classification Search
USPC ..... 439/607.05, 607.5, 607.51, 660, 465, 439/687, 696, 731
See application file for complete search history.

(56) References Cited

U.S. PATENT DOCUMENTS

2011/0136368 A1* 6/2011 Wu ..... H01R 13/506 439/345
2013/0095676 A1* 4/2013 Wu ..... H01R 9/2408 439/76.1
2014/0134888 A1* 5/2014 Soubh ..... H01R 13/6658 439/660
2015/0318634 A1* 11/2015 Henry ..... H01R 9/034 439/676
2015/0340796 A1* 11/2015 Lu ..... H01R 13/46 439/352

* cited by examiner

CONNECTOR WITH PLURALITY OF CIRCUIT BOARD CABLE ASSEMBLIES AND OVERMOLD

FIELD

The disclosure relates to connector assemblies and, in particular, to connector assemblies that includes an insulative housing and an overmold.

BACKGROUND

High-speed signal protocols such as, e.g., Serial Attached SCSI with high density implementation (MiniSAS HD), etc. are often used for a number of applications. For example, high-speed protocols are often used for data communication between various electronic apparatus such as storage devices in computers. Connector assemblies for high-speed protocols are often limited to generic designs including 1-piece, hollow housings.

Additionally, it may be difficult to manufacture a connector assembly for use with high-speed signal protocols that has low impedance while maintaining structural integrity (e.g., during plugging and unplugging of the connector assembly, etc.).

BRIEF SUMMARY

The disclosure relates to connector assemblies and, in particular, to connector assemblies that include an insulative housing and an overmold, among other aspects.

In many embodiments, a connector assembly may include an insulative housing, a plurality of vertically spaced apart circuit board cable assemblies, and an overmold. The insulative housing may include an insulative upper housing half and an insulative lower housing half, a side wall of the lower housing half defining at least one opening therein, and a corresponding side wall of the upper housing half having at least one latch. The upper housing half may be removably assembled to the lower housing half by the at least one opening receiving and engaging the at least one latch.

The plurality of vertically spaced apart circuit board cable assemblies may be disposed within the housing. Each circuit board cable assembly may include a printed circuit board (PCB) and a pair of shielded cables. The PCB may include an upper surface, an opposing lower surface, a mating end for engaging a mating connector, a cable end opposite the mating end, a first plurality of conductive contact pads disposed on the upper and lower surfaces at the mating end for engaging terminals of a mating connector, and a second plurality of conductive contact pads disposed on the upper and lower surfaces at the cable end and electrically connected to the first plurality of conductive contact pads. Each shielded cable of the pair of shielded cables may include a plurality of conductor sets and first and second conductive shielding films disposed on opposite first and second sides of the shielded cable. Each of the conductor sets may extend along a length of the cable and include two or more insulated conductors. Each insulated conductor may include a central conductor surrounded by a dielectric material. The first and second conductive shielding films may include cover portions and pinched portions arranged such that, in transverse cross section, the cover portions of the first and second shielding films in combination substantially surround each conductor set, and the pinched portions of the first and second shielding films in combination form pinched portions of the shielded cable on each side of each conductor set. Exposed ends of the central conductors in the pair of shielded cables may be terminated at the second plurality of conductive contact pads.

The overmold may be molded around the plurality of vertically spaced apart circuit board cable assemblies. Further, the overmold may tightly enclose at least a portion of each circuit board cable assembly along a rear to front direction of the overmold portions of the pair of shielded cables behind the cable end of the PCB, the cable end of the PCB, the exposed ends of the central conductors in the pair of shielded cables, the second plurality of conductive contact pads, and a portion of the PCB in front of the second plurality of conductive contact pads with the first plurality of conductive contact pads projecting forwardly from a front end of the overmold. The connector assembly may be assembled by first inserting the overmold in one of the upper and lower housing halves and then assembling the upper and lower housing halves.

In further embodiments, the connector assembly may include a latching member. The latching member may include a resilient arm making an oblique angle with the housing. The resilient arm may include a fixed end attached to the housing, an opposite free end, and a latch disposed between the fixed and free ends. In at least one embodiment, the fixed end may be removably attached to the housing.

In further embodiments, the at least one of the upper and lower housing halves may include a plurality of positioning protrusions and the overmold may include a corresponding plurality of positioning recesses such that when the connector assembly is assembled, the plurality of positioning recesses receive and engage the plurality of positioning protrusions to position and hold the overmold in a predetermined position within the housing. In at least one embodiment, at least one positioning recess in the plurality of positioning recesses receives and engages two or more positioning protrusions in the plurality of positioning protrusions.

In further embodiments, the connector assembly may include, or define, a thickness direction along thickness directions of the PCBs in the plurality of vertically spaced apart circuit board cable assemblies and, when assembling the connector assembly, the overmold may be configured to be inserted in one of the upper and lower housing halves only along the thickness direction of the connector assembly. In at least one embodiment, after the overmold is inserted in one of the upper and lower housing halves, the other one of the upper and lower housing halves may be configured to be assembled to the overmold and the one of the upper and lower housing halves only along the thickness direction of the connector assembly.

In further embodiments, the connector assembly may conform to SFF 8643.

In further embodiments, the impedance measured between the first plurality of conductive pads of the printed circuit board and the central conductor of the insulated conductors of the plurality of conductor sets of the pair of shielded cables is less than or equal to 110 ohms (e.g., 105 ohms, 100 ohms, etc.).

In further embodiments, the connector assembly may be configured to be applied to the an internal MiniSAS HD cable assembly using a SFP+ twinaxial ribbon cable to, e.g., further enhance routability and signal integrity performance In further embodiments, a connector assembly may include an insulative housing, a plurality of vertically spaced apart circuit board cable assemblies disposed within the housing, and an overmold. The insulative housing may include an insulative upper housing half and an insulative lower housing half, and the upper housing half may be removably assembled to the lower housing half. Each circuit board cable assembly may be configured to be coupled, or couplable, to a pair of shielded cables and may include a printed circuit board (PCB). The PCB may include an upper surface, an opposing lower surface, a mating end for engaging a mating connector, a cable end opposite the mating end, a first plurality of conductive contact pads disposed on the upper and lower surfaces at the mating end for engaging terminals of a mating connector, and a second plurality of conductive contact pads disposed on the upper and lower surfaces at the cable end. The second plurality of conductive contact pads may be electrically connected to the first plurality of conductive contact pads and electrically connectable to exposed ends of central conductors of the pair of shielded cables. The overmold may be molded around the plurality of vertically spaced apart circuit board cable assemblies. Further, the overmold may tightly enclose at least a portion of each circuit board cable assembly along a rear to front direction of the overmold portions of the pair of shielded cables behind the cable end of the PCB, the cable end of the PCB, the exposed ends of the central conductors in the pair of shielded cables, the second plurality of conductive contact pads, and a portion of the PCB in front of the second plurality of conductive contact pads with the first plurality of conductive contact pads projecting forwardly from a front end of the overmold. The connector assembly may be assembled by first inserting the overmold in one of the upper and lower housing halves and then assembling the upper and lower housing halves. The connector assembly may include a thickness direction along thickness directions of the PCBs in the plurality of vertically spaced apart circuit board cable assemblies, and, when assembling the connector assembly, the overmold may be configured to be inserted in one of the upper and lower housing halves only along the thickness direction of the connector assembly.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The disclosure may be more completely understood in consideration of the following detailed description of various embodiments of the disclosure in connection with the accompanying drawings, in which.

DETAILED DESCRIPTION

Figure 1:
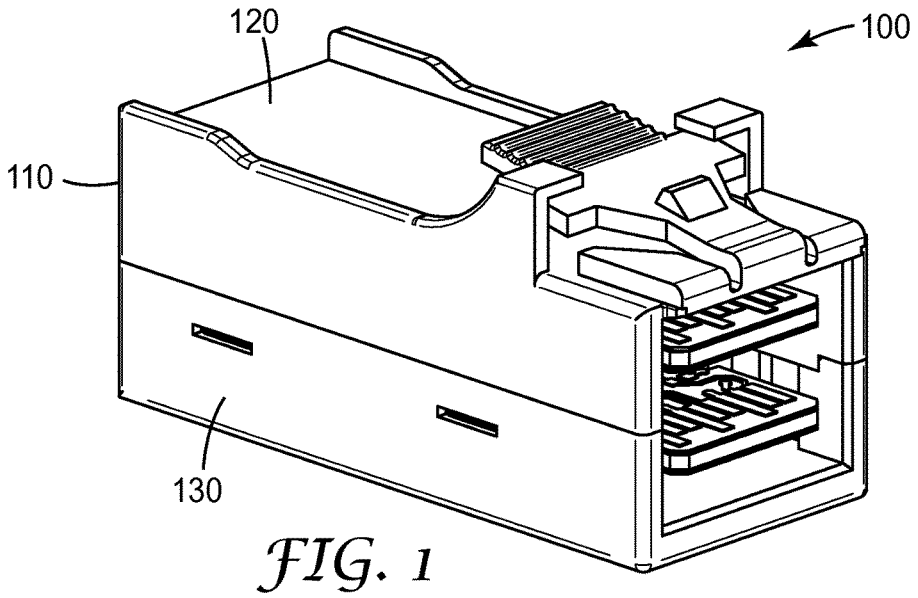
FIG. 1 is a perspective view of an exemplary connector assembly.

In the following detailed description, reference is made to the accompanying drawings that form a part hereof, and in which are shown by way of illustration several specific embodiments. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

The present disclosure relates to connector assemblies and, in particular, to connector assemblies that includes an insulative housing and an overmold, among other aspects. The exemplary cable assemblies described herein may include a snap-fitting, symmetrical or asymmetrical 2-piece insulative housing for protection of a termination portion of the cable assembly. The overmold and insulative housing may be configured to be coupled together to securely locate, or hold, at least one PCB and at least one shielded cable within the insulative housing. The overmold may include one or more polymer materials that may be molded around the PCB(s) and shielded cable(s). The overmold and the insulative housing may include various mating features such as apertures, recesses, indentions, stubs, protrusions, pins, etc. that may be configured to mate (e.g., be located adjacent one another) to provide alignment and secure coupling between the overmold and the insulative housing. The insulative housing may include an upper portion and a lower portion that may be removably coupled to each other around the overmold. The insulative housing may be referred to as a detachable 2-piece housing, which, e.g., may accommodate reworking of cable assemblies should there be any defect in one or more of its components and increase yield. For example, the 2-piece housing may be detachable therefore increasing manufacturing yield should there be any defect on one or more components of cable assembly. In other words, the convenience of disassembling the cable assembly may allow defective parts to be detected and replaced at a shorter duration. While the present disclosure is not so limited, an appreciation of various aspects of the disclosure will be gained through a discussion of the examples provided below.

Figure 2:
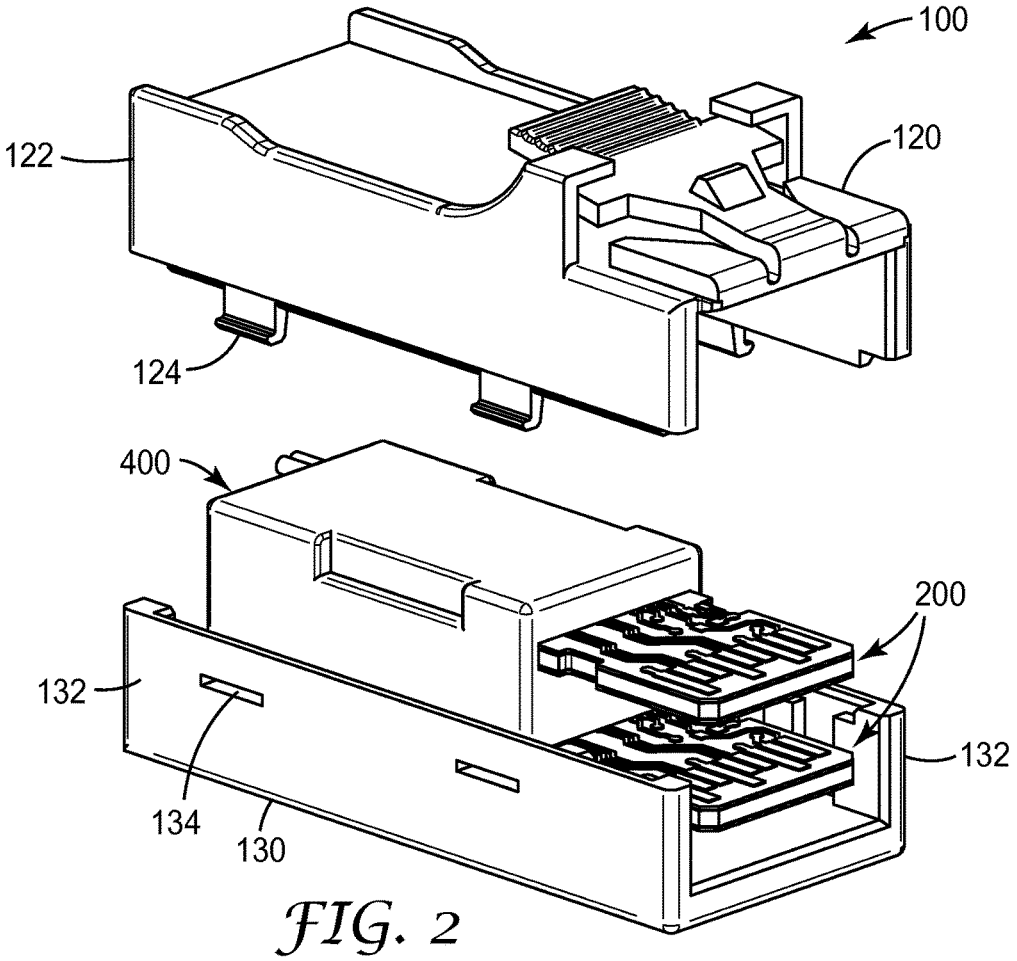
FIG. 2 is an exploded perspective view of the connector assembly of FIG. 1.

FIG. 1 is a perspective view of an exemplary connector assembly 100 and FIG. 2 is an exploded perspective view of the connector assembly 100 of FIG. 1. As shown, the connector assembly 100 may include a housing 110. The housing 110 may be configured to insulate and securely position, or hold, one or more components of the connector assembly 100 at least partially or entirely located within the housing 110. The housing 110 may include insulative, or dielectric, material, and thus, be referred to as an "insulative" housing. The insulative material of the housing 110 may include any suitable polymeric material, etc.

The housing 110 may include an upper housing half, or portion, 120 and a lower housing half, or portion 130 that may be coupled, or attached, to one another. In other words, the upper housing half 120 may be coupled, or attached, to the lower housing half 130, and vice versa. Although each of the upper and lower housing halves 120, 130 are described herein as being "halves," it is to be understood that each of the upper and lower housing halves 120, 130 may not be substantially "half" of the housing 110, and instead, by describing each of the upper and lower housing halves 120, 130 has halves, it is to be understood that the housing 110 includes two portions, namely the upper housing half 120 and the lower housing half 130.

Additionally, the upper housing half 120 and the lower housing half 130 may be described as being removably coupled to one another. As used herein, "removably coupled" may be defined as a coupling between two elements, or objects, that may remain coupled to one another upon the application of normal operating forces and may be uncoupled, or removed from being coupled, by the application of a selected amount of force (e.g., greater than the normal operating forces) in one or more selected, or particular, directions. For example, after a user couples (e.g., snaps together) the upper housing half 120 and the lower housing half 130, the upper housing half 120 and the lower housing half 130 may remain coupled together during normal operation until a user may decide to uncouple the upper housing half 120 from the lower housing half 130. Further, each of the upper and lower housing halves 120, 130 may be insulative, and thus, be referred to as insulative housing halves.

The upper housing half 120 and the lower housing 130 may be coupled together, or assembled, using any suitable methods including, but not limited to, snap fit, friction fit, press fit, mechanical clamping, etc. Additionally, many different structures such as, e.g., latches, openings, protrusions, etc., may be used to provide the coupling between the upper housing half 120 and the lower housing half 130. As shown FIG. 2, a side wall 132 of the lower housing half 130 may define at least one (e.g., one or more, a plurality, only one, etc.) opening 134 therethrough (or partially therein) and a corresponding side wall 122 (e.g., corresponding to the side wall 132 of the lower housing half 130) of the upper housing half 120 may define at least one latch 124. The at least one opening 134 and the at least one latch 124 may be configured to engage with each other (e.g., snap-fit to each other) to assemble, or couple, the lower housing half 130 to the upper housing half 120. For example, the upper housing half 130 may be removably assembled to the lower housing half 130 by the at least one opening 134 receiving and engaging the at least one latch 124. The at least one latch 124 may extend within the at least one opening 134 in a direction transverse, or perpendicular, to a thickness direction 401 described further herein with reference to FIGS. 7A-7D. The housing 110 may include an upper housing half 120 having four latches 124, two latches 124 located extending from each side wall 122, and a lower housing half 130 having four openings 134, two openings 134 located through (or partially therein) each side wall 132.

Figure 3A:
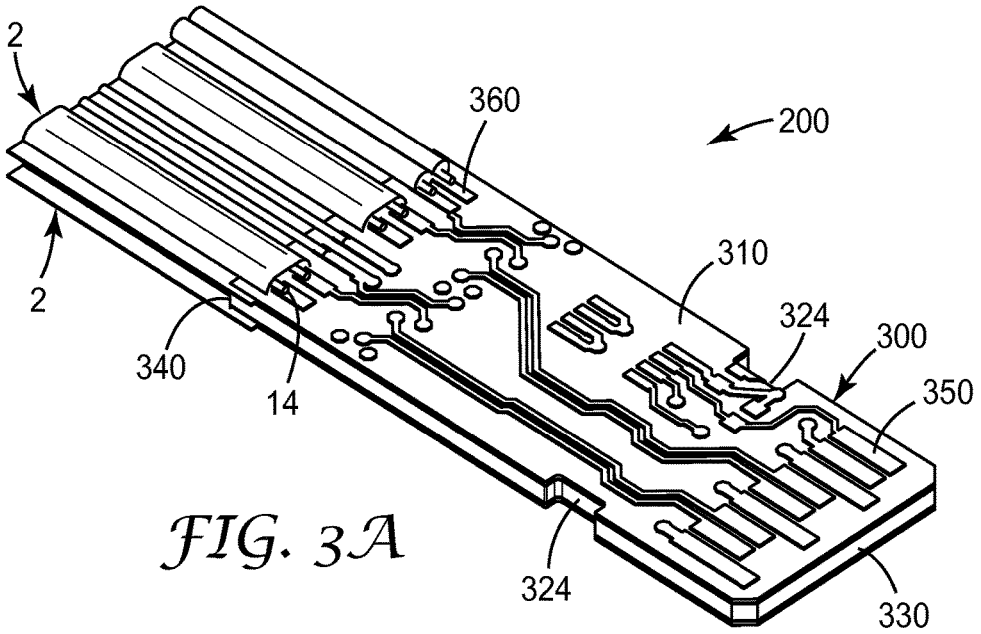
FIG. 3A is a top perspective view of an exemplary circuit board cable assembly of the connector assembly of FIG. 1.
Figure 3B:
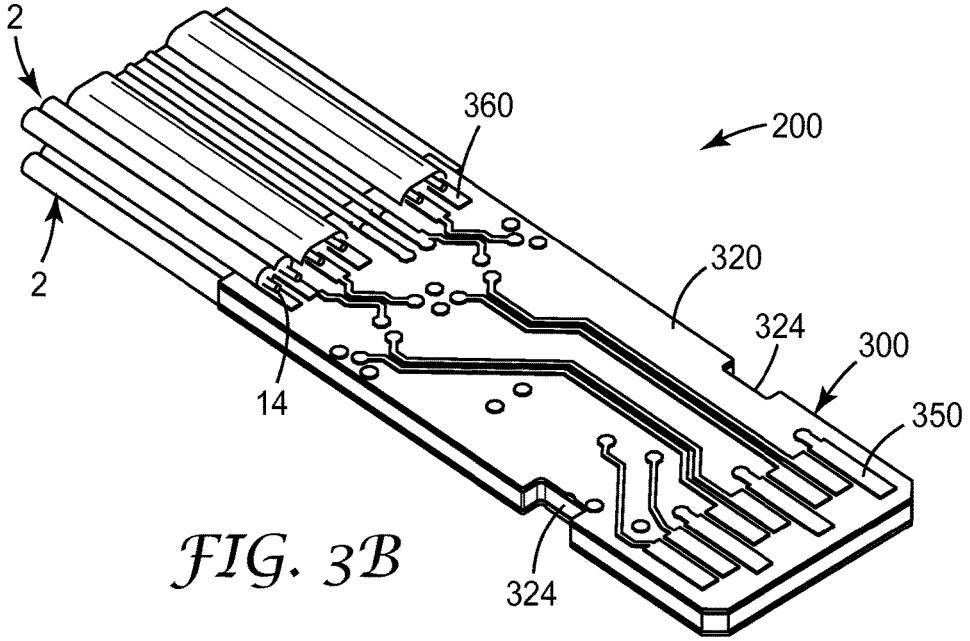
FIG. 3B is a bottom perspective view of the circuit board cable assembly of FIG. 3A.

The exemplary connector assembly 100 may further include one or more (e.g., a plurality, only one, two, etc.) circuit board cable assemblies 200, one of which is shown in FIGS. 3A-3B, which depict top and bottom perspective views, respectively. The exemplary circuit board cable assembly 200 of the connector assembly 100 may include a printed circuit board (PCB) 300 and a pair of shielded cables 2. As shown in FIG. 2, the circuit board cable assemblies 200 may be vertically spaced apart from one another. As used herein, "vertically spaced apart" may mean that the circuit board cable assemblies 200 may be separated by space in the thickness direction 401 described further herein with respect to FIGS. 7A-7D or in a direction perpendicular to the plane of each PCB 300 of the assemblies 200. Additionally, each PCB 300 may be arranged such that the plane of each PCB 300 may be parallel to each other.

The printed circuit board (PCB) 300 may include an upper surface 310 and an opposing lower surface 320, a mating end 330, and a cable end 340 opposite the mating end 330. The mating end 330 may be configured to, or for, engaging a mating connector. In other words, the mating end 330 may be a male interface configured to be coupled to the mating connector, which may be a female interface.

Each of the PCBs 300 may further define one or more notches 324 that may be used for positioning of the circuit board cable assemblies 200 within the housing 110, which will be described further herein with respect to FIGS. 7A-7D.

A plurality of conductive contact pads may be disposed (e.g., located on the surfaces 310, 320 of the PCB 300) at each end 330, 340 of the PCB 300 for electrical connection to a mating connector and a shield cable 2, respectively. More specifically, a first plurality of conductive contact pads 350 may be disposed on one or both of the upper and lower surfaces 310, 320 at the mating end 330 for engaging terminals of a mating connector, e.g., when a mating connector is coupled to the connector assembly 100. Further, a second plurality of conductive contact pads 360 may be disposed on one or both of the upper and lower surfaces 310, 320 at the cable end 340. The second plurality of conductive contact pads 360 may be configured to be coupled a shielded cable 2 as described further herein. Additionally, the second plurality of conductive contact pads 360 may be electrically connected, or coupled, to the first plurality of conductive contact pads 350, e.g., through conductive traces located on and/or through the PCB 300, through one or more wires extending along the PCB 300, etc.

Figure 4:
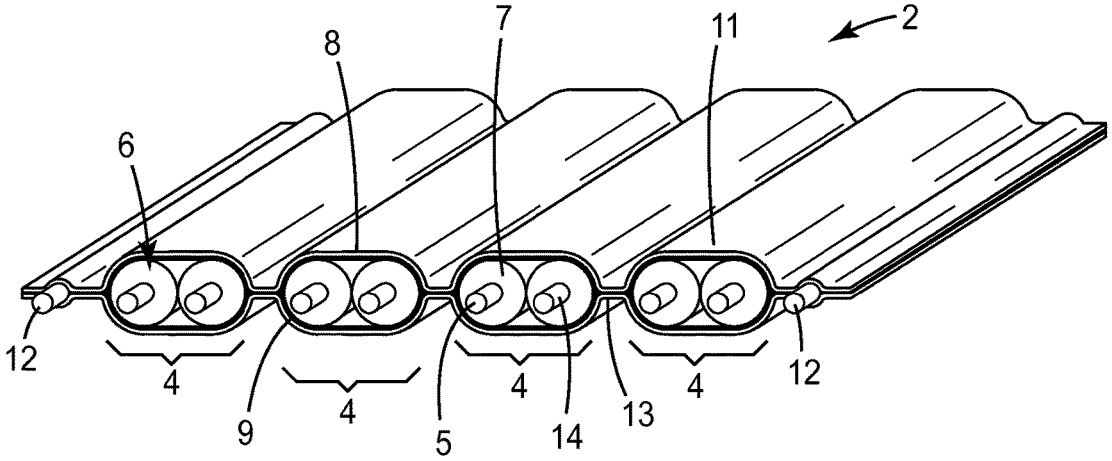
FIG. 4 is a perspective end view of an exemplary shielded cable for use with the circuit board cable assembly of FIG. 3A.

An exemplary shielded cable 2 for use with the circuit board cable assembly 200 is depicted in FIG. 4. The shielded cable 2 may include a plurality of conductor sets 4 and conductive shielding films 8, 9 disposed, or located, on either side of the shielded cable 2. Although the shielded cable 2 as shown includes 2 shielding films 8, 9, it is to be contemplated that the conductor sets 4 may be encapsulated, or wrapped, with a single shielding film, or more than two shielding films.

Each of the conductor sets 4 may extend along a length of the shielded cable 2 (e.g., from a first end region to a second end region) and may include two or more insulated conductors 6. Each insulated conductor 6 may include a central conductor 5 surrounded by, or wrapped in, a dielectric material 7. The central conductor 5, as self-described, may include conductive material such as, e.g., copper, aluminum, etc. Likewise, the dielectric material 7 may include one or more dielectric, or nonconductive, materials such, e.g., one or more polymers.

The first and second conductive shielding films 8, 9 may include, or form, cover portions 11 and pinched portions 13 along the shielded cable 2. The cover portions 11 and the pinched portions 13 may be arranged such that, in a transverse cross section as partially shown in the perspective end view in FIG. 4, the cover portions 11 of the first and second shielding films 8, 9 in combination substantially surround each conductor set 4, and the pinched portions 13 of the first and second shielding films 8, 9 in combination form pinched portions 13 of the shielded cable 2 on each side of each conductor set 4. In other words, the first and second shielding films 8, 9 form cover portions 11 that extend around each conductor set 4 and pinched portions 13 between each conductor set 4. The cover portions 11 and the pinched portions 13 may be formed by locating the first shielding film 8 above the conductor sets 4 and the second shielding film 9 below the conductors set 4 and coupling (e.g., bonding, thermo-welding, adhering, etc.) the shielding films 8, 9 to form the pinched portions 13, and in turn, form the cover portions 11.

The shielded cable 2 may further include ground conductors 12 extending along a length of the shielded cable 2. The ground conductors 12 may be electrically coupled to the first and second shielding films 8, 9 (e.g., pinched between each of the first and second shielding films 8, 9) to, e.g., provide electromagnetic shielding for the conductor sets 4. Additionally, the outside of the shielded cable 2 may be insulated from the environment, such as, e.g., any object (e.g., one or more components located within a server case) or any user that may touch the shielded cable 2. To insulate the shielded cable 2 (or more particularly, the first and second shielding films 8, 9) from the environment, the first and second shielding films 8, 9 may be coated in, or surrounded by, one or more dielectric materials such as, e.g., one or more polymers, etc.

As shown, the dielectric material 7 and the conductive shielding 8, 9 disposed on opposed first and second sides of the shielded cable 2 may leave exposed ends 14 of the central conductors 5 exposed to allow conductive coupling, or attachment, of the central conductors 5 to conductive elements such as the conductive pads 360 of the PCB 300. As shown in FIGS. 3A-3B, the exposed end 14 of the central conductors 5 are terminated at (e.g., electrically coupled to, soldered to, laser welded, etc.) the conductive pads 360.

Figure 5A:
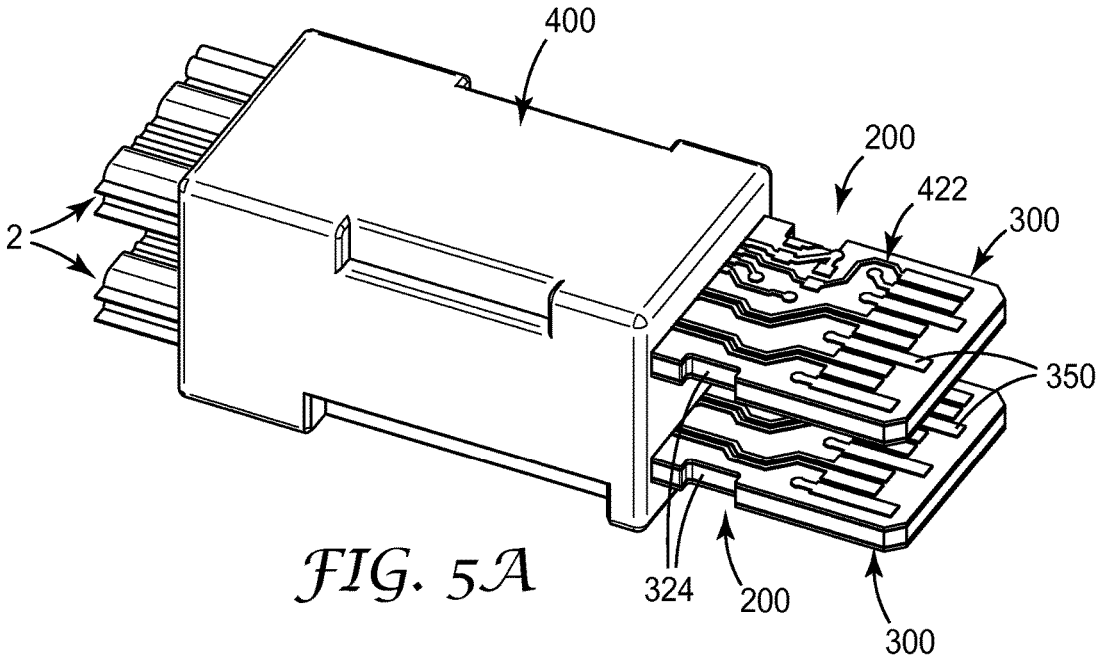
FIG. 5A is a side perspective view of an exemplary overmold and circuit board cable assembly of the connector assembly of FIG. 1.
Figure 5B:
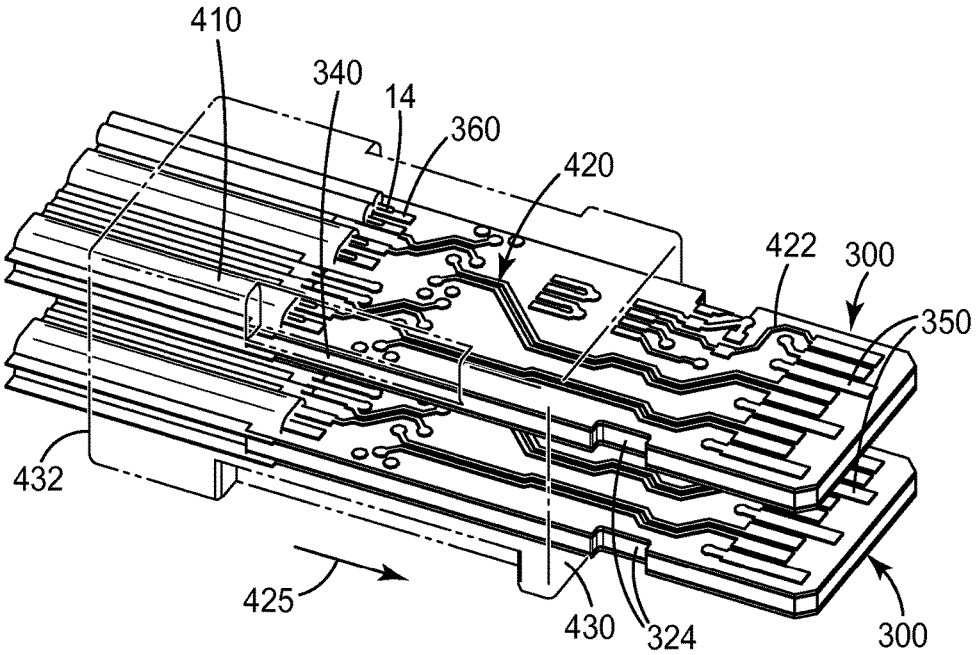
FIG. 5B is a side perspective view of the exemplary overmold and circuit board cable assembly of FIG. 5A with the overmold being translucent.

The exemplary connector assembly 100 may further include an overmold 400 located around the one or more circuit board cable assemblies 200 as shown in FIGS. 5A-5B. The overmold 400 may be molded around, or about, the circuit board cable assemblies 200. In at least one embodiment, the overmold 400 may be formed by locating the circuit board cable assemblies 200 within a two-piece mold, injecting overmold 400 material in a fluid state into the two-piece mold, and allowing the overmold 400 material to cure around the circuit board cable assemblies 200. In other words, the overmold 400 may be "injection" molded.

Further, the overmold 400 may be described as being a unitary piece that is permanently molded around and/or in between the one or more circuit board cable assemblies 200 in such a way that the overmold cannot be removed and reassembled and, furthermore, it cannot be removed from what it is molded over without at least damaging the overmold. In other words, the material of the overmold 400 may be located around and in between each of the one or more circuit board cable assemblies 200. Additionally, the material of the overmold 400 may fill-in the space between the circuit board cable assemblies 200. Still further, the overmold 400 may be in flush contact with the portion 420 of the upper and lower surfaces 310, 320 of the PCBs 300, e.g., as opposed to merely touching a small portion or region of the PCBs 300 such as the edges of the PCBs 300 (e.g., such as in a cable organizer or holder, in which the cables and/or PCBs may be removable therefrom). Further, after the overmold 400 has been applied or coupled to the circuit board cable assembles 200, the PCBs 300 and the shielded cables 2 may not be removable from the overmold 400. In other words, the circuit board cable assemblies 200 (including the PCBs 300 and the shield cables 2) may be permanently coupled to the overmold 400. In one or more embodiments, the overmold 400 may be defined as being one continuous piece or of unitary construction (e.g., the overmold 400 may be described as being "integral," etc.). A unitary construction refers to a construction that does not have any internal interfaces, joints, or seams. In some cases, a unitary structure or construction is capable of being formed in a single forming step such as machining, casting or molding. A unitary construction or article is not formed by bonding components parts together. Additionally, the PCBs 300 may be coated with a layer of material such as, e.g., epoxy, prior the overmold 400 being molded thereabout.

Although the overmold 400 may be described herein as being one continuous piece or of unitary construction, it is to be understood that the overmold 400 may have many different constructions. For example, in at least one embodiment, the overmold 400 may include a one or more overmold portions, each being formed, or molded, around one PCB 300, and subsequently, each of the overmold portions may be coupled, or bonded, together using any suitable method/structure, including but not limited to snap fit, friction fit, press fit, and mechanical clamping, to form overmold 400. Additionally, although as described herein, the overmold 400 is configured to be used with two circuit board cable assemblies 200, it is to be understood that the overmold 400 may be used with only one circuit board assembly 200 or more than two circuit board assemblies 200 depending on the configuration of the connector assembly 100.

The overmold 400 may extend around one or more portions or components of the connector assembly 100, e.g., to provide secure attachment between portions/components, to provide protection of one or more portions/components, to provide insulation of one or more portions/components, etc. Further, the overmold 400 may provide for proper spacing between circuit board cable assemblies 200 without the use of a spacer, or equivalent item, located between the circuit board cable assemblies 200. Additionally, the overmold 400 may define one or more features such as, e.g., indentations, protrusions, apertures, recesses, etc. configured to mate with one or more features of the housing 110, which will be described further herein.

The overmold 400 may tightly enclose each circuit board cable assembly 200 along a rear to front direction 425 as shown in FIG. 5B and at least a portion of the pair of shielded cables 2 behind the cable end 340 of the PCB 300, the cable end 340 of the PCB 300, the exposed ends 14 of the central conductors 5 in the pair of shielded cables 2, the second plurality of conductive contact pads 360, and a portion, or region, 420 of the PCB 300 in front of the second plurality of conductive contact pads 360 with the first plurality of conductive contact pads 350 projecting forwardly from a front end 430 of the overmold 400. In other words, the overmold 400 may extend about, or around, the connector assembly 100 from the shielding films 8, 9 of the shielded cables 2 to a portion 420 of the PCB 300 located beyond the second plurality of conductive contact pads 360 but not beyond the first plurality of conductive pads 350 such that, e.g., an exposed portion, or region, 422 of the PCB 300 may be exposed. In this configuration, the overmold 400 may be configured to insulate the second plurality of conductive pads 360. Further, the overmold 400 may be configured to provide structural stability between the second plurality of conductive pads 360 and the exposed ends 14 of the shielded cables 2. For example, if a force were applied to the shielded cables 2 in a direction opposite that of the front direction 425 (e.g., the front direction extending from the rear end 432 to the front end 430) while the overmold 400 were held, or secured, stationary, the force would be transferred to the overmold 400 instead of the electrical coupling, or connection, between the second plurality of conductive pads 360 and the exposed ends 14.

Figure 6A:
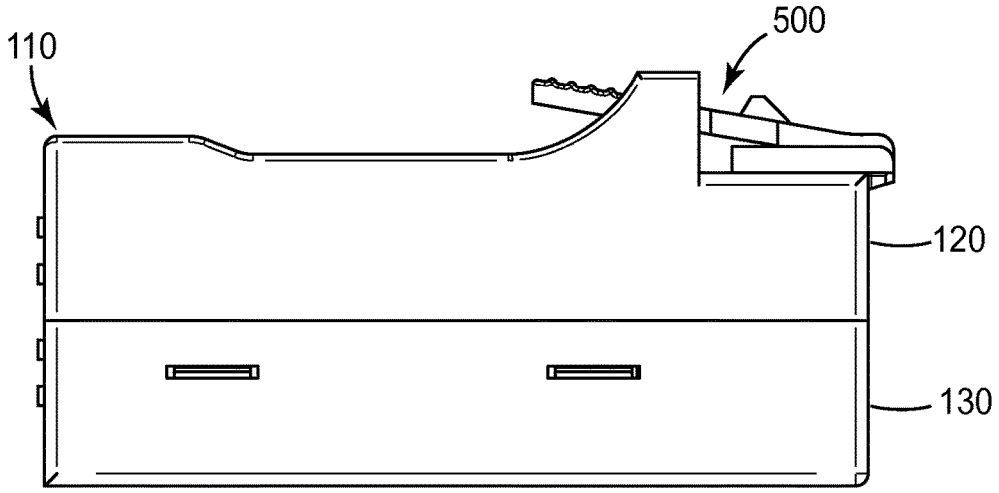
FIG. 6A is a side perspective view of the housing of the connector assembly of FIG. 1 showing an angle formed by an exemplary latching member.
Figure 6B:
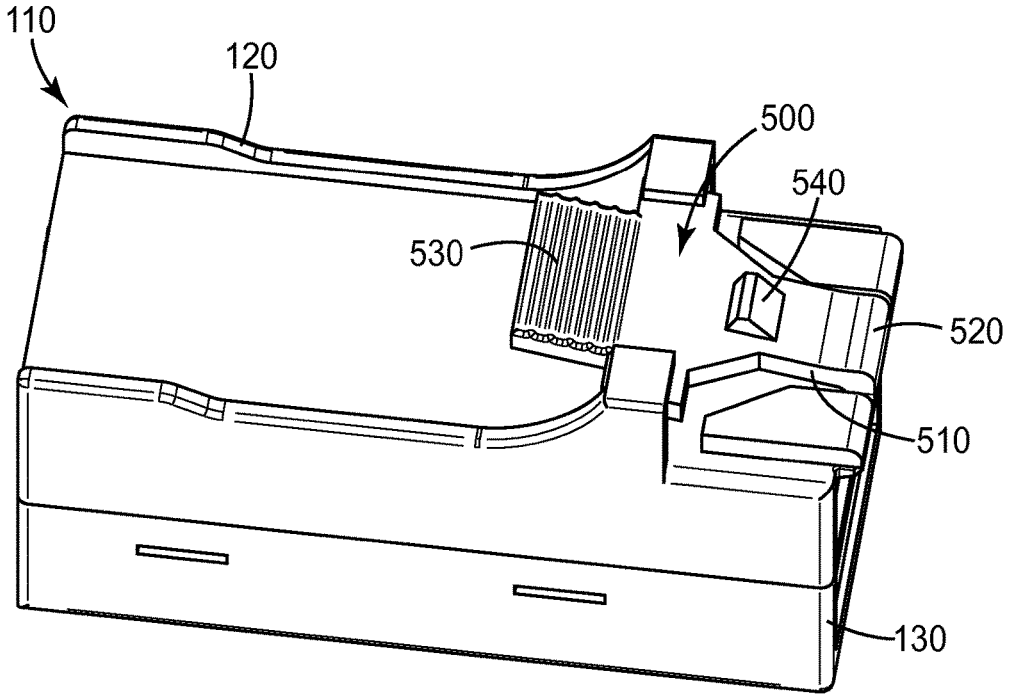
FIG. 6B is a top perspective view of the housing of the connector assembly of FIG. 1 showing the exemplary latching member of FIG. 6A.
Figure 7B:
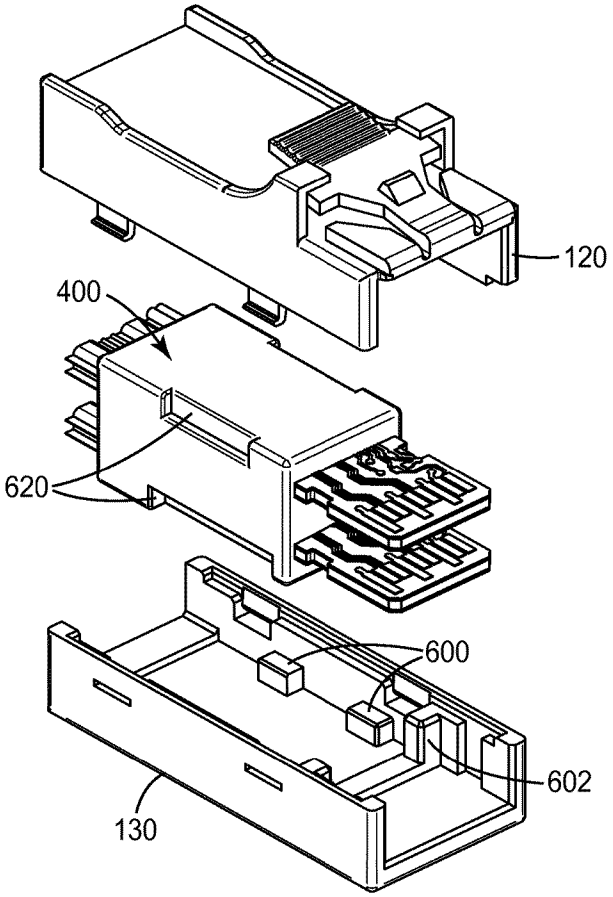
FIGS. 7A-7D are exploded perspective views of the connector assembly of FIG. 1.
Figure 7A:
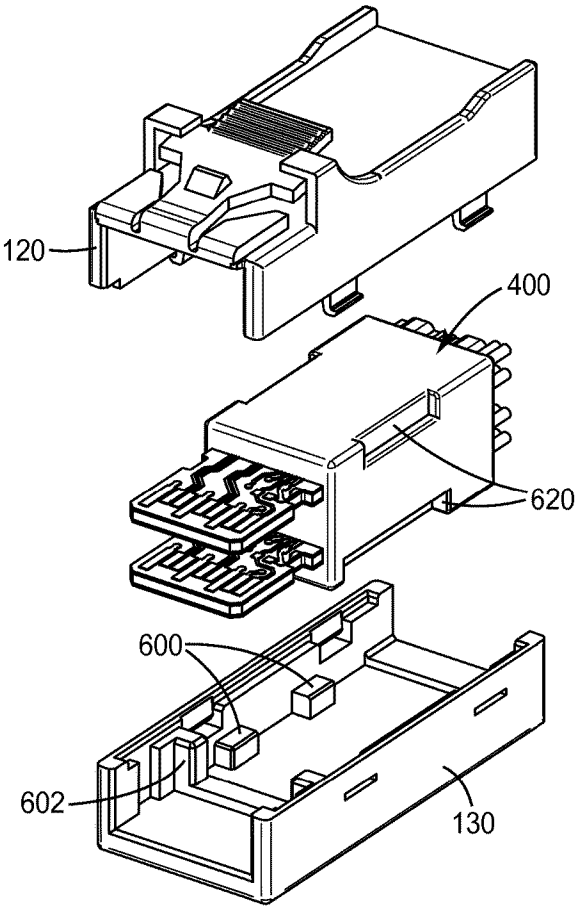
Figure 7D:
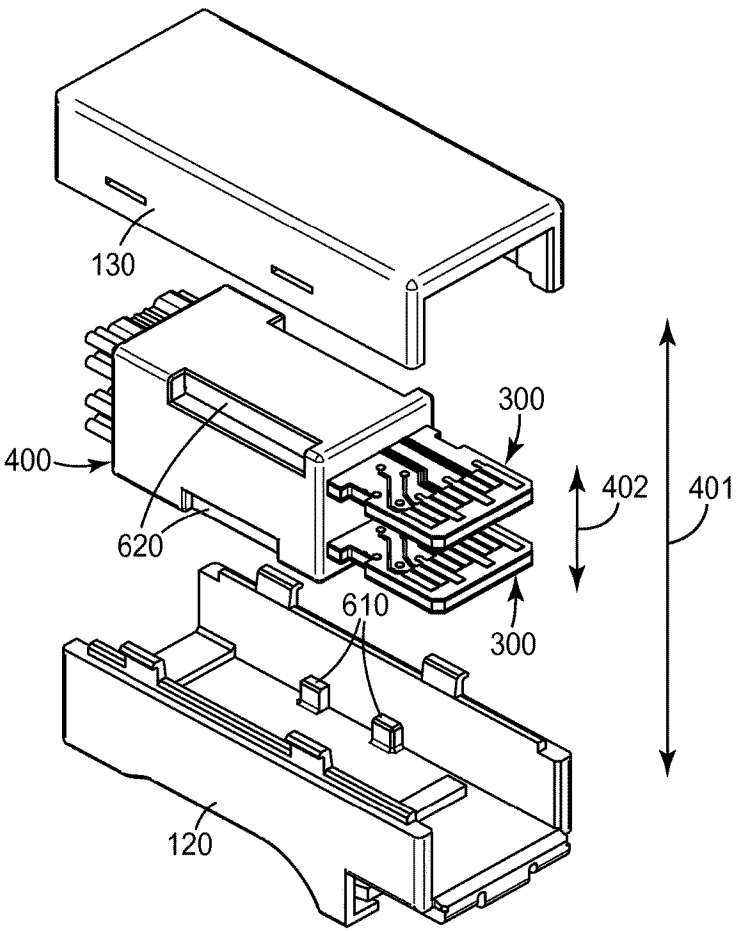
Figure 7C:
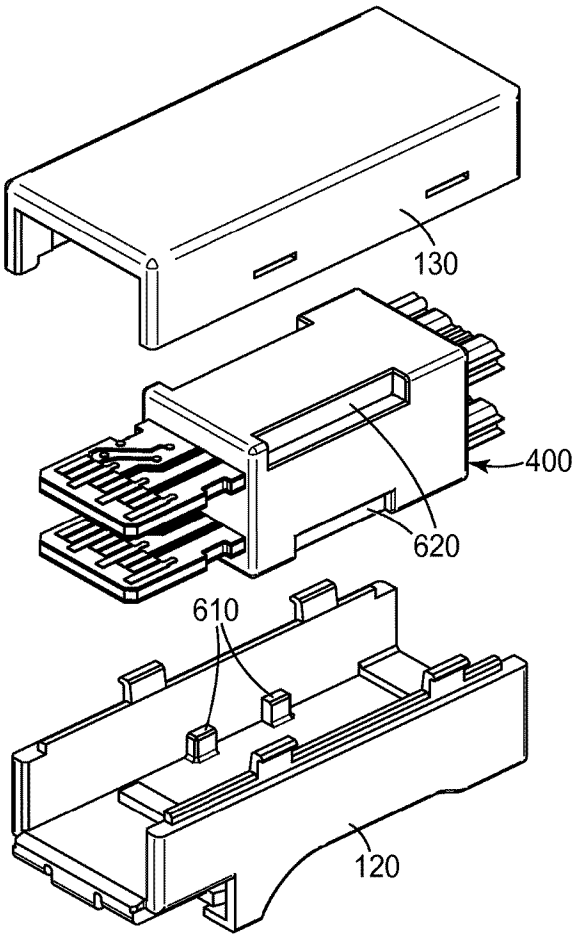

The connector assembly 100 may further include additional elements or features that may be used to couple the connector assembly 100 to a female interface, or connector. For example, as shown in FIGS. 6A-6B, the connector assembly may further include a latching member 500, e.g., configured to latch to a portion of a female interface to removably coupled the connector assembly to the female interface. The latching member 500 may include a resilient arm 510 making an oblique angle θ with the housing 110. The oblique angle θ may be greater than about 3 degrees and less than about 45 degrees. In at least one embodiment, the oblique angle θ may be about 10 to about 15 degrees. The resilient arm 510 may include a fixed end 520 attached to the housing 110, an opposite free end 530, and a latch 540 disposed between the fixed and free ends 520, 530. The latch 540 may be a protrusion extending from the surface of the resilient arm 510 that may be configured to engage, or latch, within a portion (e.g., an aperture) of a female interface. The resilient arm 510 may be configured to deflect, or move, by applying force to the resilient arm 510 such that the latch 540 may be engaged or disengaged with a portion of the female interface. Further, the resilient arm 510 may be biased to position the latch 540 to engage a portion of a female interface, and a user may have to apply a force to the resilient arm 510 (e.g., to the free end 530) to disengage the connector assembly 100 from the female interface. In at least one embodiment, the fixed end 520 may be removably attached to the housing 110 such that, e.g., the latching member 500 may be removed from the housing 110 if not needed.

FIGS. 7A-7D depict exploded perspective views of the connector assembly 100. The connector assembly 100 may be assembled by first inserting the overmold 400 in either one of the upper and lower housing halves 120, 130 and then assembling the upper and lower housing halves 120, 130 along a thickness direction 401, which is along thickness directions 402 of each of PCBs 300. The thickness directions 401, 402 may be defined as directions perpendicular to each of the planes formed be the PCBs 300 of the circuit board cable assemblies 200. In other words, the thickness of the PCBs 300, or the distance between the upper and lower surfaces 310, 320 of the PCBs 300, may define the thickness directions 402 and the thickness direction 401 may be parallel the thickness directions 402. For example, the connector assembly 100 may include, or define, a thickness direction 401 along thickness directions 402 of the PCBs 300 in the plurality of vertically spaced apart circuit board cable assemblies 200. When assembling the connector assembly 100, the overmold 400 may be configured to be inserted in one of the upper and lower housing halves 120, 130 only along the thickness direction 401 of the connector assembly 100.

Further, after the overmold 400 is inserted in one of the upper and lower housing halves 120, 130, the other one of the upper and lower housing halves 120, 130 may be configured to be assembled to the overmold 400 and the one of the upper and lower housing halves 120, 130 only along the thickness direction 401 of the connector assembly 100. In other words, each of the upper housing half 120, lower housing half 130, and the overmold 400 may be assembled to each other only along the thickness direction 401. Further, the connector assembly 100 may be disassembled in a similar, but opposite, process as the assembly thereof. For example, one of the upper and lower housing halves 120, 130 may be removed from the other along the thickness direction 401, and then the overmold 400 may be removed from one of the halves 120, 130 (the half within which the overmold 400 remains) also along the thickness direction. Since the couplings between the upper housing half 120 and the lower housing half 130 and between the housing halves 120, 130 and the overmold 400 are not permanent, such components, or elements thereof, may not be deformed or destroyed due to disassembly.

One or more features may be included in the upper housing half 120, lower housing half 130, and the overmold 400 to align each of the upper housing half 120, lower housing half 130 and the overmold 400 during assembly and to provide support to circuit board cable assemblies 200. For example, the upper housing half 120 and lower housing half 130 may include features such as protrusions, indentations, recesses, etc. that correspond to similar features of the overmold 400. Such features may mate together, or be located adjacent to each other, to provide aid in assembly and provide support.

As shown in FIGS. 7A-7D, at least one of the upper and lower housing halves 120, 130 may include a plurality of positioning protrusions 600, 610 and the overmold 400 may include a corresponding plurality of positioning recesses 620 such that when the connector assembly 100 is assembled, the plurality of positioning recesses 620 receive and engage the plurality of positioning protrusions 600, 610 to position and hold the overmold 400 in a predetermined position within the housing 110. Further, as shown, each positioning recess 620 receives two positioning protrusions 600, 610 separated by space. In other words, at least one positioning recess 620 in the plurality of positioning recesses 620 may receive and engage two or more positioning protrusions 600, 610 in the plurality of positioning protrusions 600, 610. In other embodiments, any number of positioning recesses 620 and positioning protrusions 600, 610 may be included in the connector assembly 100 to provide adequate support.

As described herein, each of the PCBs 300 may further define one or more notches 324 located in an exposed portion 422 of the PCBs 300. The notches 324 may correspond to vertical protrusions 602 of, or defined by, the lower housing half 130. For example, when the connector assembly 100 is assembled within the overmold 400 including the circuit board cable assemblies 200, the notches 324 may be mate, or engage, the vertical protrusions 602 of the lower housing half 130 to, e.g., provide further support to the circuit board cable assemblies 200.

The exemplary connector assembly 100 described herein may be configured to be used in multiple different high-speed signal protocols such as, e.g., MiniSAS HD, etc. As shown, the connector assembly 100 may conform to SFF 8643, an integrated connector receptacle specification, developed by and available from the Small Form Factor (SFF) committee.

The exemplary connector assembly 100 may provide low impedance across its electrical connections to conform to various industry standards. For example, an impedance measured between a conductive pad of the first plurality of conductive pads 350 of the PCB 300 and a corresponding central conductor 5 of the insulated conductors 6 of the plurality of conductor sets 3 of the pair of shielded cables 2 may be less than or equal to 115 ohms, less than or equal to 110 ohms, less than or equal to 105 ohms, less than or equal to 100 ohms, etc.

The following are a list of items of the present disclosure:

Item 1 is a connector assembly, comprising:

an insulative housing comprising an insulative upper housing half and an insulative lower housing half, a side wall of the lower housing half defining at least one opening therein, a corresponding side wall of the upper housing half having at least one latch, the upper housing half being removably assembled to the lower housing half by the at least one opening receiving and engaging the at least one latch;

a plurality of vertically spaced apart circuit board cable assemblies disposed within the housing, each circuit board cable assembly comprising:

a printed circuit board (PCB) comprising:

an upper surface and an opposing lower surface;

a mating end for engaging a mating connector and a cable end opposite the mating end;

a first plurality of conductive contact pads disposed on the upper and lower surfaces at the mating end for engaging terminals of a mating connector; and a second plurality of conductive contact pads disposed on the upper and lower surfaces at the cable end and electrically connected to the first plurality of conductive contact pads; and a pair of shielded cables, each shielded cable comprising:

a plurality of conductor sets, each conductor set extending along a length of the cable and comprising two or more insulated conductors, each insulated conductor comprising a central conductor surrounded by a dielectric material;

first and second conductive shielding films disposed on opposite first and second sides of the shielded cable, the first and second conductive shielding films including cover portions and pinched portions arranged such that, in transverse cross section, the cover portions of the first and second shielding films in combination substantially surround each conductor set, and the pinched portions of the first and second shielding films in combination form pinched portions of the shielded cable on each side of each conductor set; exposed ends of the central conductors in the pair of shielded cables being terminated at the second plurality of conductive contact pads; and an overmold molded around the plurality of vertically spaced apart circuit board cable assemblies, the overmold tightly enclosing each circuit board cable assembly along a rear to front direction of the overmold portions of the pair of shielded cables behind the cable end of the PCB, the cable end of the PCB, the exposed ends of the central conductors in the pair of shielded cables, the second plurality of conductive contact pads, and a portion of the PCB in front of the second plurality of conductive contact pads with the first plurality of conductive contact pads projecting forwardly from a front end of the overmold, wherein the connector assembly is assembled by first inserting the overmold in one of the upper and lower housing halves and then assembling the upper and lower housing halves.

Item 2 is the connector assembly of item 1 further comprising a latching member comprising a resilient arm making an oblique angle with the housing and having:

a fixed end attached to the housing;

an opposite free end; and a latch disposed between the fixed and free ends.

Item 3 is the connector assembly of item 2, wherein the fixed end is removably attached to the housing.

Item 4 is the connector assembly of item 1, wherein at least one of the upper and lower housing halves comprises a plurality of positioning protrusions and the overmold comprises a corresponding plurality of positioning recesses such that when the connector assembly is assembled, the plurality of positioning recesses receive and engage the plurality of positioning protrusions to position and hold the overmold in a predetermined position within the housing.

Item 5 is the connector assembly of item 4, wherein at least one positioning recess in the plurality of positioning recesses receives and engages two or more positioning protrusions in the plurality of positioning protrusions.

Item 6 is the connector assembly of item 1 comprising a thickness direction along thickness directions of the PCBs in the plurality of vertically spaced apart circuit board cable assemblies, wherein when assembling the connector assembly, the overmold is configured to be inserted in one of the upper and lower housing halves only along the thickness direction of the connector assembly.

Item 7 is the connector assembly of item 6, wherein after the overmold is inserted in one of the upper and lower housing halves, the other one of the upper and lower housing halves is configured to be assembled to the overmold and the one of the upper and lower housing halves only along the thickness direction of the connector assembly.

Item 8 is the connector assembly of item 1, wherein the connector assembly conforms to SFF 8643.

Item 9 is the connector assembly of item 1, wherein impedance measured between a conductive pad of the first plurality of conductive pads of the printed circuit board and a corresponding central conductor of the central conductor of the insulated conductors of the plurality of conductor sets of the pair of shielded cables is less than or equal to 110 ohms.

Item 10 is a connector assembly, comprising:

an insulative housing comprising an insulative upper housing half and an insulative lower housing half, the upper housing half being removably assembled to the lower housing half;

a plurality of vertically spaced apart circuit board cable assemblies disposed within the housing, each circuit board cable assembly couplable to a pair of shielded cables and comprising:

a printed circuit board (PCB) comprising:

an upper surface and an opposing lower surface;

a mating end for engaging a mating connector and a cable end opposite the mating end;

a first plurality of conductive contact pads disposed on the upper and lower surfaces at the mating end for engaging terminals of a mating connector; and a second plurality of conductive contact pads disposed on the upper and lower surfaces at the cable end, wherein the second plurality of conductive contact pads are electrically connected to the first plurality of conductive contact pads and electrically connectable to exposed ends of central conductors of the pair of shielded cables; and an overmold molded around the plurality of vertically spaced apart circuit board cable assemblies, the overmold tightly enclosing each circuit board cable assembly along a rear to front direction of the overmold portions of the pair of shielded cables behind the cable end of the PCB, the cable end of the PCB, the exposed ends of the central conductors in the pair of shielded cables, the second plurality of conductive contact pads, and a portion of the PCB in front of the second plurality of conductive contact pads with the first plurality of conductive contact pads projecting forwardly from a front end of the overmold, wherein the connector assembly is assembled by first inserting the overmold in one of the upper and lower housing halves and then assembling the upper and lower housing halves, wherein the connector assembly comprises a thickness direction along thickness directions of the PCBs in the plurality of vertically spaced apart circuit board cable assemblies, wherein when assembling the connector assembly, the overmold is configured to be inserted in one of the upper and lower housing halves only along the thickness direction of the connector assembly.

Thus, embodiments of CONNECTOR ASSEMBLY are disclosed. One skilled in the art will appreciate that the compositions described herein can be practiced with embodiments other than those disclosed. The disclosed embodiments are presented for purposes of illustration and not limitation.

What is claimed is:

1. A connector assembly, comprising:

an insulative housing comprising an insulative upper housing half and an insulative lower housing half, a side wall of the lower housing half defining at least one opening therein, a corresponding side wall of the upper housing half having at least one latch, the upper housing half being removably assembled to the lower housing half by the at least one opening receiving and engaging the at least one latch;

a plurality of vertically spaced apart circuit board cable assemblies disposed within the housing, each circuit board cable assembly comprising:

a printed circuit board (PCB) comprising:

an upper surface and an opposing lower surface;

a mating end for engaging a mating connector and a cable end opposite the mating end;

a first plurality of conductive contact pads disposed on the upper and lower surfaces at the mating end for engaging terminals of a mating connector; and a second plurality of conductive contact pads disposed on the upper and lower surfaces at the cable end and electrically connected to the first plurality of conductive contact pads; and a pair of shielded cables, each shielded cable comprising:

a plurality of conductor sets, each conductor set extending along a length of the cable and comprising two or more insulated conductors, each insulated conductor comprising a central conductor surrounded by a dielectric material;

first and second conductive shielding films disposed on opposite first and second sides of the shielded cable, the first and second conductive shielding films including cover portions and pinched portions arranged such that, in transverse cross section, the cover portions of the first and second shielding films in combination substantially surround each conductor set, and the pinched portions of the first and second shielding films in combination form pinched portions of the shielded cable on each side of each conductor set; exposed ends of the central conductors in the pair of shielded cables being terminated at the second plurality of conductive contact pads; and an overmold molded around the plurality of vertically spaced apart circuit board cable assemblies, the overmold tightly enclosing each circuit board cable assembly along a rear to front direction of the overmold portions of the pair of shielded cables behind the cable end of the PCB, the cable end of the PCB, the exposed ends of the central conductors in the pair of shielded cables, the second plurality of conductive contact pads, and a portion of the PCB in front of the second plurality of conductive contact pads with the first plurality of conductive contact pads projecting forwardly from a front end of the overmold, wherein the connector assembly is assembled by first inserting the overmold in one of the upper and lower housing halves and then assembling the upper and lower housing halves.

2. The connector assembly of claim 1 further comprising a latching member comprising a resilient arm making an oblique angle with the housing and having:

a fixed end attached to the housing;

an opposite free end; and a latch disposed between the fixed and free ends.

3. The connector assembly of claim 2, wherein the fixed end is removably attached to the housing.

4. The connector assembly of claim 1, wherein at least one of the upper and lower housing halves comprises a plurality of positioning protrusions and the overmold comprises a corresponding plurality of positioning recesses such that when the connector assembly is assembled, the plurality of positioning recesses receive and engage the plurality of positioning protrusions to position and hold the overmold in a predetermined position within the housing.

5. The connector assembly of claim 4, wherein at least one positioning recess in the plurality of positioning recesses receives and engages two or more positioning protrusions in the plurality of positioning protrusions.

6. The connector assembly of claim 1 comprising a thickness direction along thickness directions of the PCBs in the plurality of vertically spaced apart circuit board cable assemblies, wherein when assembling the connector assembly, the overmold is configured to be inserted in one of the upper and lower housing halves only along the thickness direction of the connector assembly.

7. The connector assembly of claim 6, wherein after the overmold is inserted in one of the upper and lower housing halves, the other one of the upper and lower housing halves is configured to be assembled to the overmold and the one of the upper and lower housing halves only along the thickness direction of the connector assembly.

8. The connector assembly of claim 1, wherein the connector assembly conforms to SFF 8643.

9. The connector assembly of claim 1, wherein impedance measured between a conductive pad of the first plurality of conductive pads of the printed circuit board and a corresponding central conductor of the central conductor of the insulated conductors of the plurality of conductor sets of the pair of shielded cables is less than or equal to 110 ohms.

10. A connector assembly, comprising:

an insulative housing comprising an insulative upper housing half and an insulative lower housing half, the upper housing half being removably assembled to the lower housing half;

a plurality of vertically spaced apart circuit board cable assemblies disposed within the housing, each circuit board cable assembly couplable to a pair of shielded cables and comprising:

a printed circuit board (PCB) comprising:

an upper surface and an opposing lower surface;

a mating end for engaging a mating connector and a cable end opposite the mating end;

a first plurality of conductive contact pads disposed on the upper and lower surfaces at the mating end for engaging terminals of a mating connector; and a second plurality of conductive contact pads disposed on the upper and lower surfaces at the cable end, wherein the second plurality of conductive contact pads are electrically connected to the first plurality of conductive contact pads and electrically connectable to exposed ends of central conductors of the pair of shielded cables; and an overmold molded around the plurality of vertically spaced apart circuit board cable assemblies, the overmold tightly enclosing each circuit board cable assembly along a rear to front direction of the overmold portions of the pair of shielded cables behind the cable end of the PCB, the cable end of the PCB, the exposed ends of the central conductors in the pair of shielded cables, the second plurality of conductive contact pads, and a portion of the PCB in front of the second plurality of conductive contact pads with the first plurality of conductive contact pads projecting forwardly from a front end of the overmold, wherein the connector assembly is assembled by first inserting the overmold in one of the upper and lower housing halves and then assembling the upper and lower housing halves, wherein the connector assembly comprises a thickness direction along thickness directions of the PCBs in the plurality of vertically spaced apart circuit board cable assemblies, wherein when assembling the connector assembly, the overmold is configured to be inserted in one of the upper and lower housing halves only along the thickness direction of the connector assembly.

* * * * *